US007267070B2

(12) United States Patent
Le Page et al.

(10) Patent No.: US 7,267,070 B2
(45) Date of Patent: Sep. 11, 2007

(54) DEVICE FOR CONTROLLING STEERING OF A TOWED UNDERWATER OBJECT

(75) Inventors: Yann Le Page, Marseilles (FR); Frederic Schom, Marseilles (FR)

(73) Assignee: Cybernetix, Marseilles Cedex (FR)

( * ) Notice: Subject to any disclaimer, the term of this patent is extended or adjusted under 35 U.S.C. 154(b) by 0 days.

(21) Appl. No.: 11/131,297

(22) Filed: May 18, 2005

(65) Prior Publication Data

US 2005/0268835 A1 Dec. 8, 2005

(30) Foreign Application Priority Data

May 18, 2004 (FR) ..... 04 05430

(51) Int. Cl.
*B63B 21/66* (2006.01)

(52) U.S. Cl. ..... 114/245; 343/709; 343/719

(58) Field of Classification Search ..... 114/330, 114/331, 152, 244, 245; 367/17; 343/709, 343/719

See application file for complete search history.

(56) References Cited

U.S. PATENT DOCUMENTS 3,943,483 A 3/1976 Strange
6,011,752 A 1/2000 Ambs et al.
6,091,670 A * 7/2000 Oliver et al. ..... 367/76
6,144,342 A 11/2000 Bertheas et al.

* cited by examiner

*Primary Examiner*—Sherman Basinger
(74) *Attorney, Agent, or Firm*—Young & Thompson

(57) ABSTRACT

A device for controlling steering of a towed underwater object, in particular a towed linear acoustic antenna. The device comprises a body having a longitudinal axis, the body being provided with a fastener for fastening it releasably to the towed object, and a plurality of stabilizer fins, each of which is coupled to the body and extends along an axis that is transverse to the longitudinal axis of said body, the angular position of each fin relative to the body being pivotable about its transverse axis by control, so as to modify the angles of inclination of said fins.

13 Claims, 5 Drawing Sheets

DEVICE FOR CONTROLLING STEERING OF A TOWED UNDERWATER OBJECT

The invention relates to a device for controlling steering of a towed underwater object, such as, in particular a towed linear acoustic antenna.

BACKGROUND OF THE INVENTION

In particular for acquiring seismic data (in particular in three dimensions), it is known that an underwater object (such as the above-mentioned antenna) can be towed at sea.

Typically, said antenna is rather like a long cable. Typically, a plurality of (often about ten) cables are disposed side-by-side, and towed together.

It is important to position them correctly relative to one another (in particular so as to prevent them from crossing over one another). It is also useful to define and to control the depth to which they are immersed.

Such devices for controlling the steering of towed underwater objects have already been proposed.

However, problems remain that are related, in full or in part, to the reliability and the effectiveness of such devices, to their cost, and to their ease use of and/or of maintenance.

OBJECTS AND SUMMARY OF THE INVENTION

In order to provide a solution to all or some of the above problems, it is firstly proposed for the device of the invention to comprise:

- a body having a longitudinal axis, the body being provided with fastener means for fastening it releasably to the towed object; and
- a plurality of stabilizer fins, each of which is coupled to the body and extends along an axis that is transverse to the longitudinal axis of said body, the angular position of each fin relative to the body being pivotable about its transverse axis by control means, so as to modify the angles of inclination of said fins.

A problem often encountered when the device and the towed underwater object are in operation, and being towed behind a tow ship, relates to untimely encounters with obstacles. The progress and the effectiveness of the object and/or of the device can then be hindered, and the object and/or the device can even be damaged.

In order to provide a solution to those problems, it is proposed:

- for the body to comprise:
  - a stationary inner portion provided with fastener means for fastening to the towed underwater object; and
  - an outer shell that is movable in rotation relative to the stationary inner portion, about said longitudinal axis; and
- for each fin to be coupled at one end to a shaft that extends substantially radially relative to said longitudinal axis, and that passes through the moving outer shell so as to co-operate with a lug engaged in a circular groove provided in a ring extending coaxially about said stationary inner portion, the lug sliding in the groove when each fin and the moving outer shell turn about said longitudinal axis of the body.

Thus, the fins and the outer shell can "escape" by pivoting about the longitudinal axis of the body, in the event of untimely encounters with obstacles.

In connection with all or some of the above, it is also recommended for the device of the invention to be provided with three fins disposed about the longitudinal axis, with two bottom fins defining a V-shape between them and one top fin that is substantially vertical, said control means acting on said fins to adapt the depth of immersion and the lateral position of the device relative to a reference axis along which the towed underwater object substantially extends.

An important aspect of the invention addresses the problem related to driving the (or each) fin about the corresponding transverse axis effectively and reliably.

In connection with this aspect, it is proposed, in the invention:

- for each fin to be pivoted about its transverse axis by means of an eccentric coupled at a first end to the transverse shaft of said fin and at a second end to the lug engaged in the circular groove of the corresponding ring, which ring is mounted coaxially and slidably about said stationary inner portion, so that the fin in question pivots about its transverse axis by the ring moving along the longitudinal axis of the body; and/or
- for each fin to be pivoted about its transverse axis by means of a cam having a pivot axis that is offset relative to the pivot axis of the corresponding fin and that is mounted to move in a slot extending over an angular sector of a plane that is substantially radial relative to said longitudinal axis, the cam being driven by a shaft mounted to turn about an axis that is transverse to said longitudinal axis, the shaft being driven by a wheel that is driven by a rotary device having an angular transmission itself driven by rotary drive means mounted to turn about an axis that is substantially parallel to the longitudinal axis of the body; and
- in connection with the preceding characteristic, for the rotary shaft to have, if necessary, at its free end, an eccentric which is mounted to move in said slot, thereby defining the cam which angularly positions each fin, the slot being provided in said ring which extends about the stationary inner portion of the body, so that the fin in question pivots about its transverse axis by said ring moving along the longitudinal axis of the body.

The second characteristic above makes it possible, in particular, to keep the pitch angles of the fins constant, while allowing the device to pivot about the "longitudinal" axis of the body.

In particular with a "tripod" system comprising three fins as indicated above, it is recommended for the device to be provided with at least as many of said circular grooves as there are of said fins, said circular grooves being disposed in succession along said longitudinal axis so that the fins are offset relative to one another along said longitudinal axis.

A mechanism that is relatively simple and reliable is thus guaranteed without adversely affecting balance and stability.

Another problem encountered concerns the possibility of winding the device of the invention and the towed underwater object together onto large drums (in particular when said object is cable-like as indicated), without having to remove the control devices of the invention that are placed at intervals along the cable/object, and without any risk of damaging said devices.

Another solution proposed in the invention consists in that:

- the moving outer shell of the body comprises two half-shells that are separable from each other and from the stationary inner portion; and
- the pivot shaft of each fin is coupled removably to the inner portion;

so that the fins and the moving outer shell of the body are separable from the inner portion of said body, in particular when said inner portion is connected to said towed underwater object.

Another problem encountered concerns the manner in which pivoting of the fins is controlled from inside the body.

For this purpose, it is recommended:

for the (or each) fin to be pivoted about its transverse axis by at least one electric motor that operates intermittently so as to deflect the fin in question, each motor being connected for this purpose, and preferably for each fin, to at least one capacitor having charging and discharging times, the motor being switched on during the discharging time of the capacitor and being switched off during its charging time, or in another configuration, for the frequency of use of the motors to result in a mean power that is constant and low; and optionally in either of the above cases, for the capacitor advantageously to be part of an electric circuit including a current source, the capacitor being charged during its charging time by a constant current.

Thus, a power supply for the motors for pivoting the fins is obtained by capacitors charging and discharging.

BRIEF DESCRIPTION OF THE DRAWINGS

Other characteristics and advantages of the invention appear from the following description of a preferred particular embodiment.

In the description:

FIG. 6 shows the arrangement of the main electronic control means;

FIG. 7 is a detailed view of a preferred embodiment of the power management device for managing the power to be delivered to the motors.

MORE DETAILED DESCRIPTION

Figure 1:
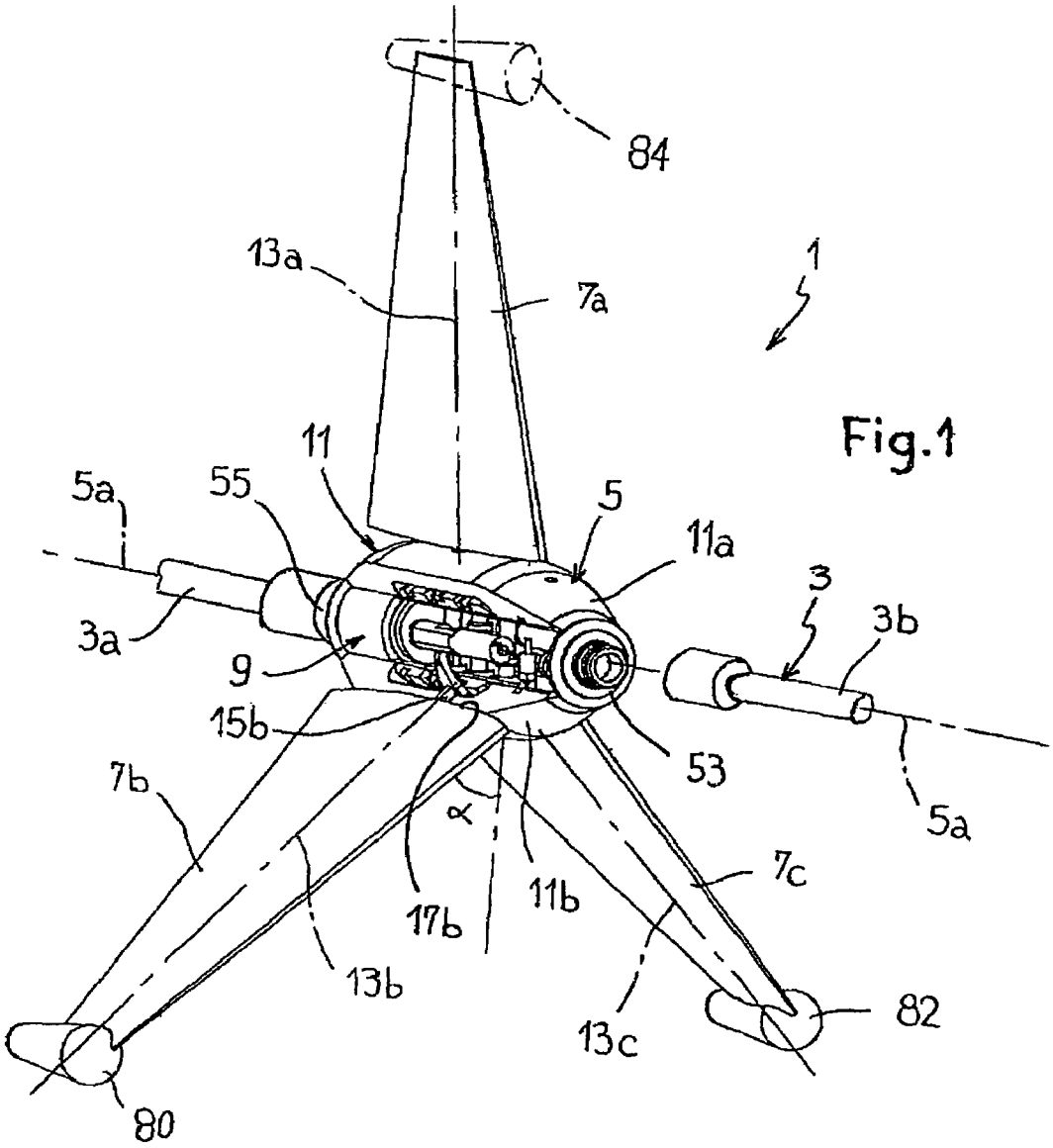
FIG. 1 is a partially cut-away perspective view of a control device of the invention.

FIG. 1 shows a holding and guide device 1 of the invention that is usable for supporting and correctly positioning a towed underwater object, in particular a towed linear acoustic antenna 3, shown diagrammatically in the form of a long cable.

The device 1 comprises a hollow central body 5 and a plurality of stabilizer fins 7*a*, 7*b*, 7*c* (three in this example) that are individually angularly positionable.

The body 5 has a longitudinal axis 5*a*.

The body comprises a stationary central portion 9 and a concentric outer shell 11 that is mounted to turn with the fins about the central portion and about the axis 5*a* so that in the event that they encounter an obstacle, the fins can escape from it laterally by pivoting about the axis 5*a*.

The fins, which extend along axes that are transverse (radial) relative to the axis 5*a* are further mounted to pivot about their respective transverse axes 13*a*, 13*b*, 13*c* (through approximately in the range 5° to 30° and preferably up to about 20°).

In order to obtain these movements, each fin is preferably fastened in the vicinity of its root, such as 17*b* for fin 7*b*, to a radial shaft (shaft 15*b* extending along the axis 13*b* for fin 7*b*).

Figure 2:
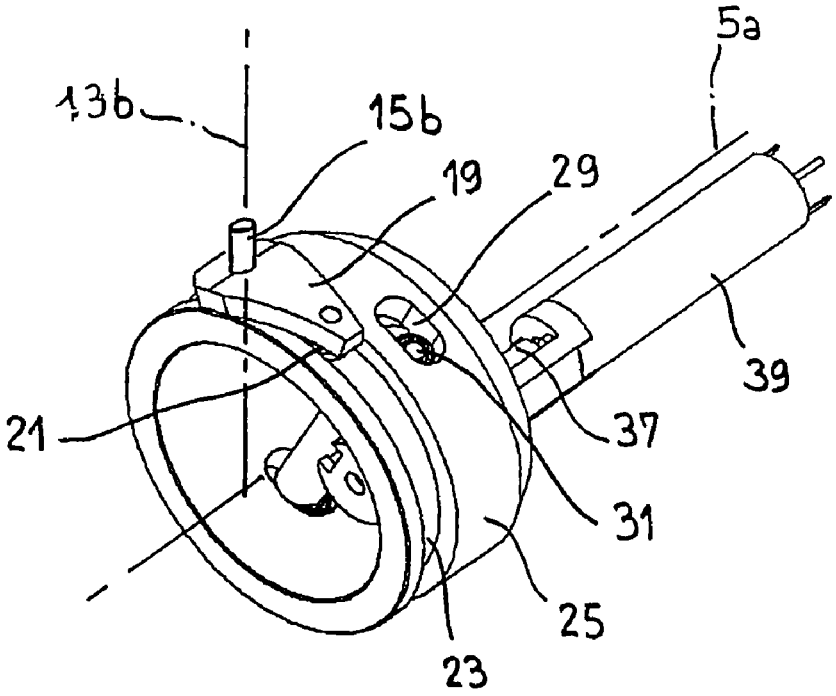
FIGS. 2 and 3 are perspective views of the control system used for causing the fins to pivot together with the outer shell about the stationary inner portion of the body.
Figure 3:
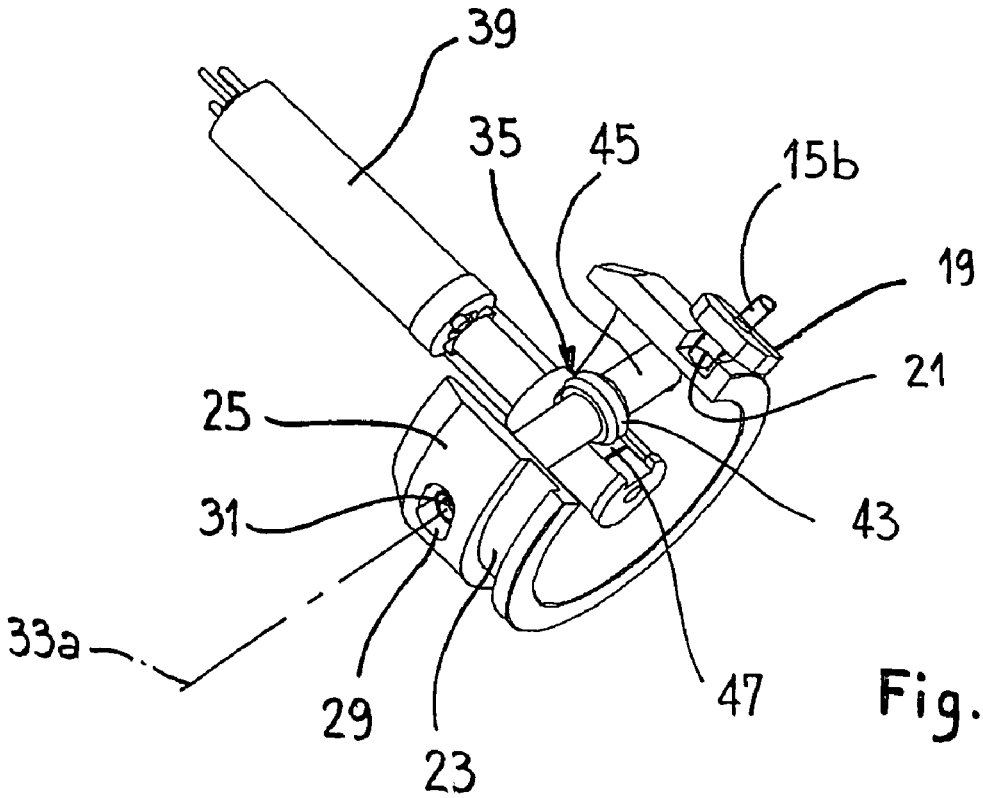

For the explanation concerning the fins, fin 7*b* is considered, with the other fins being mounted identically: the radial shaft 15*b* passes through the outer shell 11 under which it is connected in stationary manner to a transverse tab 19 provided with a stud or lug 21 which is mounted to slide in a notch or groove 23 in a ring 25 (FIGS. 2 and 3).

The groove 23 extends over the entire outside periphery of the ring concentrically therewith and in a plane extending radially relative to the axis 5*a*.

Offset (along said longitudinal axis 5*a*) relative to the groove, the ring 25 is provided with a through oblong hole (or preferably with two diametrically opposite holes) 29 in which (or in each of which) a finger 31 is movably received (FIGS. 2 and 3).

The oblong hole 29 has its long axis parallel to the circular groove 23.

It is thus in a plane that is radial relative to the axis 5*a*.

Figure 4:
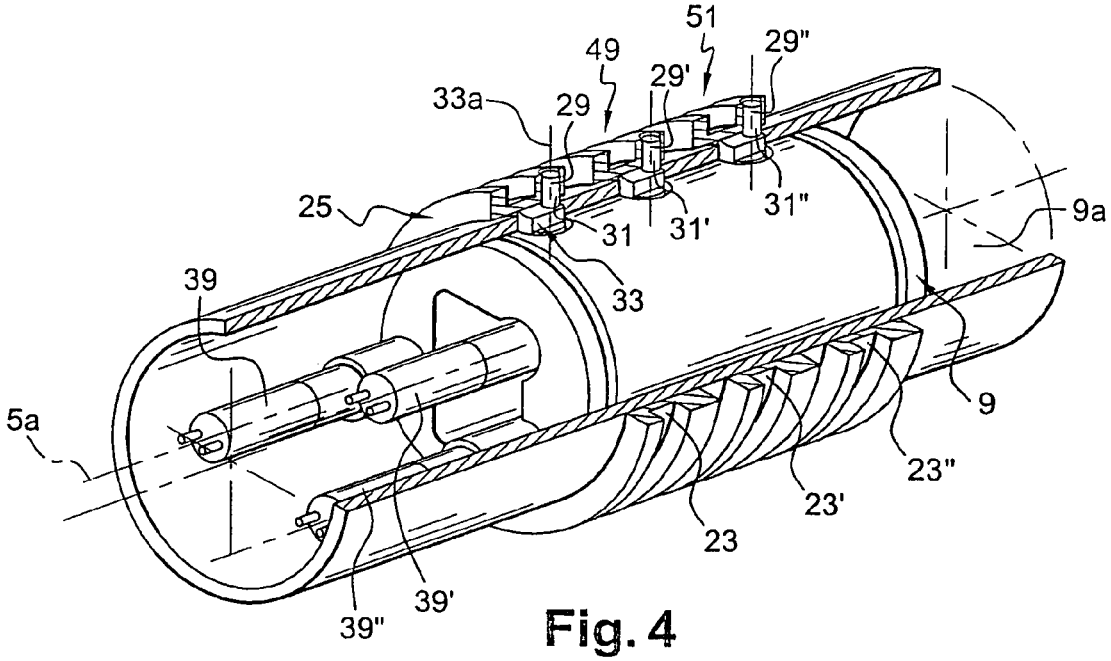
FIGS. 4 and 5 are also perspective views that are also partially cut-away, showing the control system for controlling the fins.
Figure 5:
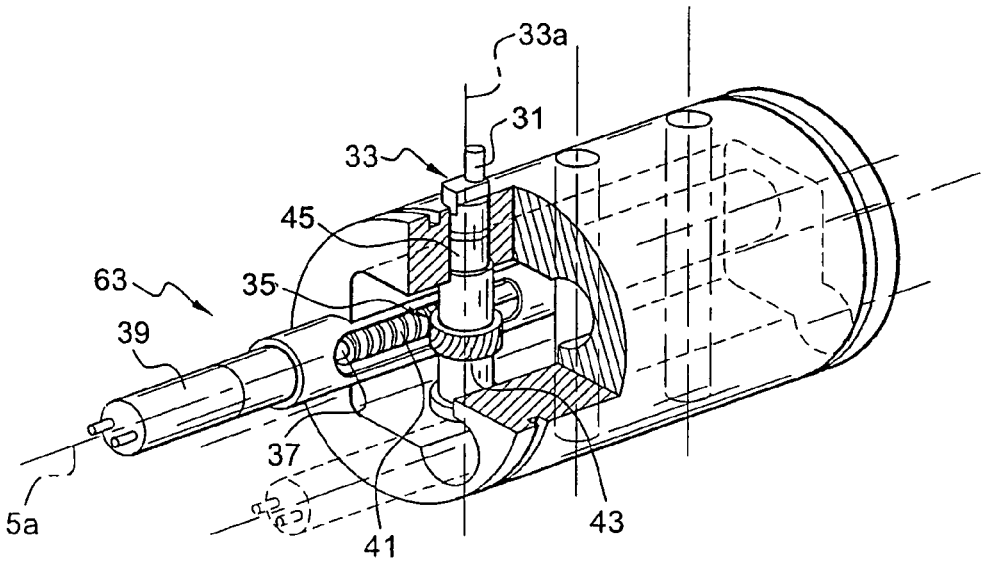

As also shown in FIG. 4 or FIG. 5, the finger 31 is an element of a radial device having a cam (or an eccentric) 33 driven by an angular transmission 35 controlled by the outlet shaft 37 (parallel to the axis 5*a*) of an electric motor 39.

In the preferred embodiment shown, the shaft 27 is more precisely controlled by a geared motor that rotates an axial screw 41 with which a radial toothed wheel 43 meshes, thereby defining the angular transmission 35 (FIGS. 3 and 5).

Radially, beyond the toothed zone 43, the wheel is extended on either side by an eccentric rod which, together with its finger 31, defines the radial cam device 33 (FIG. 5).

Said radial cam device is driven by a shaft 45 (extending in a plane that is radial relative to the axis 5*a*) mounted to turn about its own axis 33*a* and guided by the wheel 43 which rolls in a slot 47 parallel to the axis 5*a*, under the control of the outlet shaft 37 (FIG. 3).

With such a system for controlling the fins, the rings 25, 49, 51 are offset along the axis 5*a*, as are the three fins (see FIGS. 1, 4 and 5 taken together).

The angular positioning of each fin about the axis 5*a* can thus be adapted as a function of circumstances.

In operation, in the water and in a normal, stable situation, the fins are configured to comprise a vertical top fin 7*a* and two inclined bottom fins 7*b*, 7*c* preferably having that same angle a relative to the vertical passing through the fin 7*a*. This makes it possible to control depth and relative position between two lines of towed objects that are normally substantially parallel.

For the purpose of controlling depth, only the two bottom fins 7*b*, 7*c* are inclined about their axes of rotation 13*b*, 13*c*, so that the device 1 applies a vertical resultant force on the upstream and on the downstream segments 3*a*, 3*b* of the towed object to which it is connected (naturally, it is assumed that the equipment is advancing).

For the purpose of lateral control (horizontal plane), the top fin 7*a* is turned about its axis 13*a* as are the bottom fins 7*b*, 7*c* (in opposite directions to each other) in order to cancel the moment about the axis 5*a* so as to keep the system as a whole in the vertical position.

If the assembly comprising the towed object and the device 1 is advancing, typically by being towed by a surface ship, the resultant force that is applied is directed laterally relative to the axis 5*a*, leftwards or rightwards.

For coupling to upstream and downstream towed object segments 3*a*, 3*b* (coupling for mechanical, electrical, signal transmission purposes, etc.), the stationary central portion 9 of the body 5 is provided at its opposite longitudinal ends with respective first and second connection end-pieces 53, 55 for engaging with complementary end-pieces provided on the corresponding ends of said upstream and downstream segments 10, 20 of the towed object.

In addition, in particular in order to allow the towed line to be wound onto large drums, while also winding the devices 1 that are disposed at intervals along the segments in question, the outer shell 11 and the fins 7*a*, 7*b*, 7*c* are separable from the inner portion 9 of the body.

For this purpose, the fins and the inner portion 9 can be provided with a releasable interlocking system that is known per se (e.g. a bayonet-fitting system, or a screw coupling).

The outer shell 11 is advantageously made up of two half-shells 11*a*, 11*b* connected together along a plane containing the axis 5*a* and also connected together by a releasable interlocking system that is known per se.

As indicated above, among other things, the device 1 thus controls depth, by generating a vertical force on the towed object (at least on the segments that are adjacent to it) so as to establish at least one of said segments at a predefined depth.

Depth control is preferably performed by using a pressure signal.

Said signal can be delivered by a local pressure sensor 61 disposed inside the device 1 (body 9; and more particularly zone 9*a* reserved for the electronics in FIG. 4).

Another possibility consists in using a pressure signal delivered from the outside, e.g. by a cable connected to the electronics of the device 1. It is then possible to use a sensor disposed remotely and communicating with the electronic processing unit (or microcontroller 60 shown in FIG. 6) and naturally connected to the control means for controlling the inclination of the fins, which control means are described in detail above.

Advantageously, each fin is also connected to a position sensor 62 received at 9*a* and measuring the angle of inclination (absolute angle) of each fin about its radial axis.

This position information is loaded into the on-board electronics (microcontroller 60) for performing control by means of a control loop.

Figure 6:
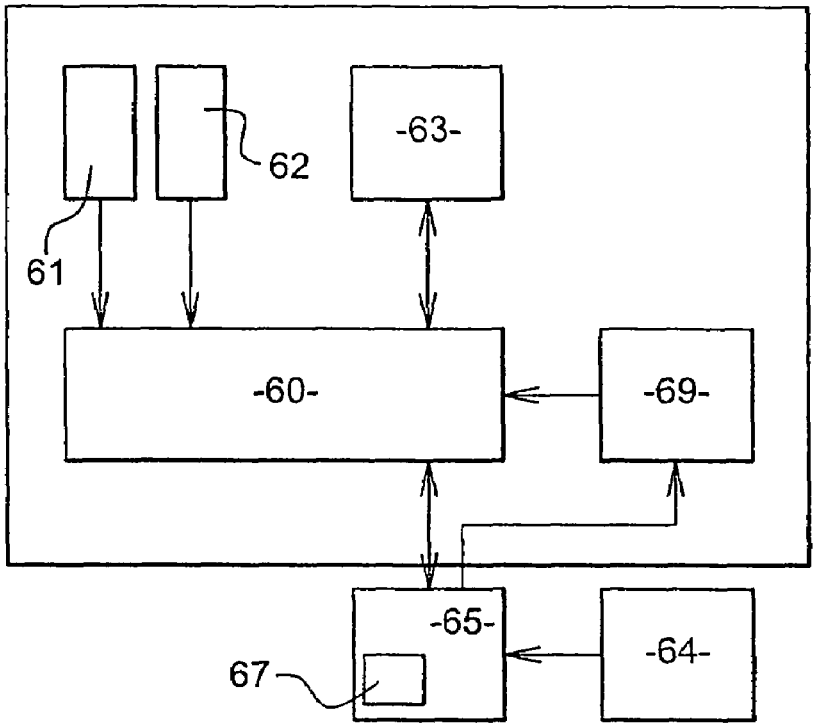
FIGS. 6 and 7 are block diagrams.

In order to control the lateral position of the device 1 and of the segments 3*a*, 3*b* adjacent to it, the on-board electronics loads into a memory the data relating to the towed line of objects that is substantially parallel to it (if such a line exists), so that the device in question is adapted to apply (via the fins driven by their actuators 63; FIGS. 5 and 6) a lateral force to the adjacent segments on which they can act, so as to adapt the relative spacing relative to the neighboring line(s).

The distance data can, in particular, be delivered by a sensor, in particular an acoustic sensor 64, delivering the data to the microcontroller 60 by any suitable communication means (in particular a cable). The sensor 64 can be received at 9*a*, or else situated remote from the device 1.

The actuators 63 of FIG. 6 relate in particular to the electric motors (such as 39) and to the angular transmission and cam (or eccentric) devices 35, 33 presented above (cf. FIG. 5).

Preferably, if the device 1 has three fins, the body 5 contains three motors (see FIG. 4) and three control devices 33, 35 associated with three circular rings (25, 49, 51 in FIG. 4) mounted to slide parallel to the axis 5*a* and thus disposed one behind the other, each with a peripheral outside groove (respectively 23, 23', 23") in which the finger of the corresponding eccentric moves and, if necessary, turns, each ring being provided with a rear through slot (29, 29', or 29") in which the finger (31, 31', 31") of the cam 33 in question is engaged.

Returning to FIG. 6, it can be seen that depth is advantageously controlled by means of a pressure sensor 61 that is responsive to the pressure in the environment of the device.

A power management system 69 (shown in more detail in FIG. 7) also makes it possible to overcome the problem of the relatively low level of electrical power available.

Thus, whenever the motors 39, 39', 39" are motors that consume relatively high power while they are in operation, they are caused to operate intermittently, so as to reach the desired angle for the fins 7*a*, 7*b*, 7*c* in successive stop-start cycles.

In this way, an acceptable mean level of electricity consumption is achieved.

In order to smooth out the consumption peaks, use is made of the charging/discharging cycles of (super-) capacitors, preferably in series.

Figure 7:
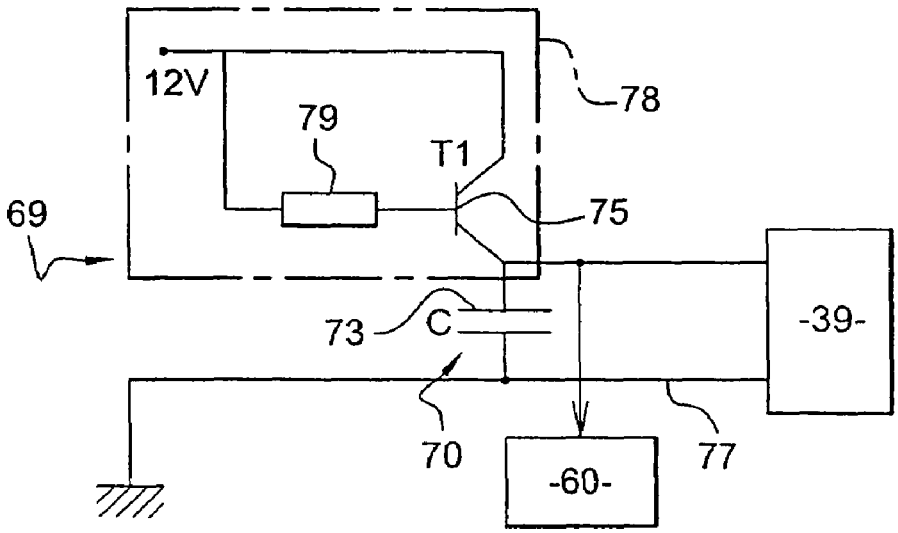
Figure 8:
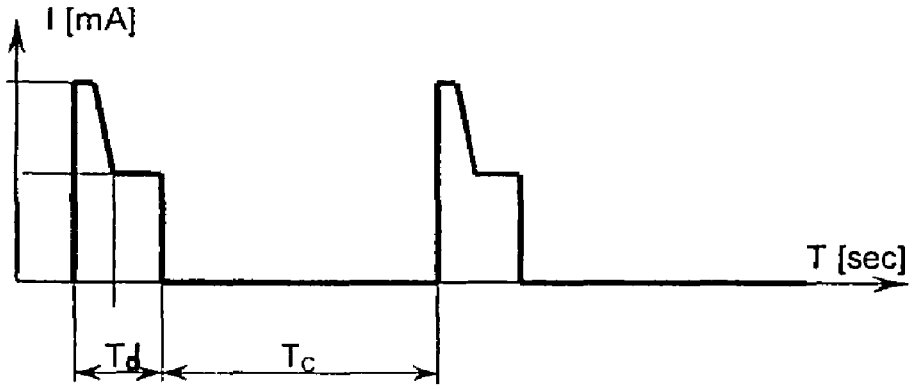
FIGS. 8 and 9 are two curves showing preferred operation of the motors.
Figure 9:
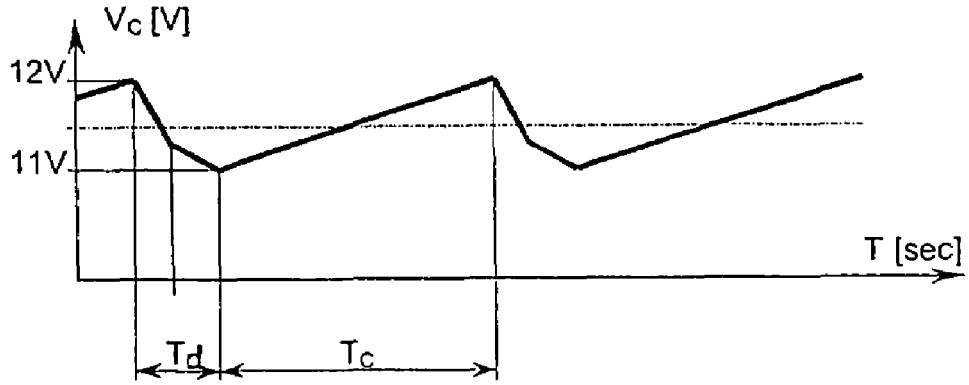

The block diagram of FIG. 7, and FIGS. 8 and 9 show that the total cycle of the (or each) capacitor (70 is Tc+Td (corresponding preferably to the period of the acquisition cycles at the input of the acoustic sensor 64).

If the (or each) motor (such as 39) in question in this example operates at an initial voltage of 12 volts (delivered by a battery of (super-) capacitors referenced 65 integrated in the interface 67 that receives the data from the sensor 64 so as to transmit said data after processing to the microcontroller 60, FIG. 6), then it will be decided, for example, to use a voltage in the range 11 volts to 12 volts approximately (FIGS. 7 and 9).

FIG. 8 shows how the current available for the motor varies correspondingly. A current of constant magnitude (coming from the battery) continuously charges the capacitor 73 connected between the transistor 75 and ground 77 (FIG. 7).

Under the control of the microcontroller 60, the current source 78 (with, for example, a battery of storage cells, the transistor 75, and the resistor 79) establishes the maximum current available for the motor 39) once the capacitor 73 is fully charged (FIGS. 7 and 9).

With, for example, six capacitors, each of 5 Farads (F), connected in series and using the above-mentioned operating principle, and with three direct current (DC) geared motors, it should be possible to cause said motors to operate for times lying in the range 2 seconds to 4 seconds (Td) approximately with intermediate stop times (Tc) lying in the range 30 seconds to 40 seconds approximately, it being possible for the total power delivered to lie in the range 4 watts to 5 watts approximately, operating at a voltage in the range 10 volts to 12 volts approximately, and lower mean DC power.

Discharging into the motors can be triggered and interrupted by comparing the voltage of the capacitors with a preprogrammed ideal maximum and with minimum voltages that are also predefined.

Such a solution also makes it possible, in an emergency, to discharge into the motors for a time longer than the scheduled time, although that will naturally require a longer re-charging time.

Concerning the angular positions of the fins, they are advantageously measured on the axes of rotation 33*a* of the devices having eccentrics 33.

For this purpose, it is possible to make provision for direct measurement, by using a rotary sensor, and in particular a contactless Hall-effect sensor.

If it is an absolute-angle sensor (preferred solution), the sensor 62 provided for each fin must be calibrated to operate properly.

To balance the device 1 while it is in operation, it is also recommended for each of the two bottom fins 7*b*, 7*c* to be provided at its free end with a respective (lead) weight 80, 82 in FIG. 1, the top fin 7*a* optionally being provided, also at its free end, with a tube 84 enclosing a lightweight block of foam or the like, that is of low density and preferably of density lower than the density of water, and that therefore floats.

What is claimed is:

1. A device for controlling steering of a towed underwater object, the device comprising:

a body having a longitudinal axis and comprising:

a stationary inner portion that is constrained in rotation relative to the towed underwater object and provided with fastener means for fastening it releasably to said object; and an outer shell that is movable in rotation relative to the stationary inner portion, about said longitudinal axis;

a plurality of stabilizer fins, each of which is coupled to the body and extends along an axis that is transverse to the longitudinal axis of said body, the angular position of each fin relative to the body being pivotable about its transverse axis, and a rotary drive system and control means for driving the angles of inclination of at least some of said fins, each of said driven fins being coupled to a shaft extending substantially radially relative to said longitudinal axis, each shaft of said driven fins passing through the moving outer shell so as to be mounted to turn, with said outer shell and about said longitudinal axis, about said inner portion in which the shaft co-operates with said rotary drive system for pivoting each of said driven fins about its corresponding transverse axis, wherein said rotary drive system comprises, for each driven fin, an eccentric coupled at a first end to the transverse shaft of said driven fin and at a second end to a lug engaged in the circular groove of a ring, which ring is mounted coaxially and slidably about said stationary inner portion, so that said driven fin pivots about its transverse axis by the ring moving along the longitudinal axis of the body.

2. The device according to claim 1, said device being provided with three fins disposed about the longitudinal axis, with two fins defining a V-shape between them and one fin that is substantially vertical, said control means acting on said fins to adapt the depth of immersion and the lateral position of the device relative to a reference axis along which the towed underwater object substantially extends.

3. The device according to claim 1, wherein said fins are weighty and are disposed in a trihedral configuration about the longitudinal axis, and said outer shell is mounted to turn relative to the stationary inner portion about said longitudinal axis to cause said one fin to be substantially vertical, in particular when in the water, regardless of the angular position of said stationary inner portion about said longitudinal axis.

4. The device according to claim 1, wherein a working power for pivoting each fin about its transverse axis is delivered by at least one electric motor which operates intermittently so as to move said driven fins, under the control of at least one capacitor provided on an electric circuit including an adjustable current source.

5. The device according to claim 1, wherein an absolute angle sensor is disposed in the stationary inner portion of the body, in order to sense the angular positioning angle of each driven fin.

6. A device for controlling steering of a towed underwater object, the device comprising:

a body having a longitudinal axis and comprising:

a stationary inner portion that is constrained in rotation relative to the towed underwater object and provided with fastener means for fastening it releasably to said object; and an outer shell that is movable in rotation relative to the stationary inner portion, about said longitudinal axis;

a plurality of stabilizer fins, each of which is coupled to the body and extends along an axis that is transverse to the longitudinal axis of said body, the angular position of each fin relative to the body being pivotable about its transverse axis, and a rotary drive system and control means for driving the angles of inclination of at least some of said fins, each of said driven fins being coupled to a shaft extending substantially radially relative to said longitudinal axis, each shaft of said driven fins passing through the moving outer shell so as to be mounted to turn, with said outer shell and about said longitudinal axis, about said inner portion in which the shaft co-operates with said rotary drive system for pivoting each of said driven fins about its corresponding transverse axis, wherein each of said driven fins is pivoted about its transverse axis by means of a cam having a pivot axis that is offset relative to the pivot axis of said driven fin and that is mounted to move in a slot extending over an angular sector of a plane that is substantially radial relative to said longitudinal axis, the cam being driven by a shaft mounted to turn about an axis that is transverse to said longitudinal axis, the shaft being driven by a wheel that is driven by rotary device having an angular transmission itself driven by rotary drive means mounted to turn about an axis that is substantially parallel to the longitudinal axis of the body.

7. The device according to claim 6, wherein the rotary drive system comprises, for each driven fin, a lug co-operating with the shaft of the corresponding fin, the lug being engaged in a circular groove provided in a ring extending coaxially about said stationary inner portion, the lug sliding in the groove when each driven fin and the moving outer shell turn about said longitudinal axis of the body.

8. The device according to claim 7, wherein the shaft has, at a free end, an eccentric which is mounted to move in said slot, thereby defining the cam which angularly positions each fin, the slot being provided in said ring which extends about the stationary inner portion of the body, so that said driven fin pivots about its transverse axis by said ring moving along the longitudinal axis of the body.

9. The device according to claim 7, said device being provided with at least as many of said circular grooves as there are of said driven fins, said circular grooves being disposed in succession along said longitudinal axis so that said driven fins are offset relative to one another along said longitudinal axis.

10. The device according to claim 6, said device being provided with three fins disposed about the longitudinal axis, with two fins defining a V-shape between them and one fin that is substantially vertical, said control means acting on said fins to adapt the depth of immersion and the lateral position of the device relative to a reference axis along which the towed underwater object substantially extends.

11. The device according to claim 6, wherein said fins are weighty and are disposed in a trihedral configuration about the longitudinal axis, and said outer shell is mounted to turn relative to the stationary inner portion about said longitudinal axis to cause said one fin to be substantially vertical, in particular when in the water, regardless of the angular position of said stationary inner portion about said longitudinal axis.

12. A device for controlling steering of a towed underwater object, the device comprising:

a body having longitudinal axis and comprising:

a stationary inner portion that is constrained in rotation relative to the towed underwater object and provided with fastener means for fastening it releasably to said object; and an outer shell that is movable in rotation relative to the stationary inner portion, about said longitudinal axis; and a plurality of stabilizer fins, each of which is coupled to the body and extends along an axis that is transverse to the longitudinal axis of said body, the angular position of at least some of said fins relative to the body being pivotable about its transverse axis by means of a rotary drive system and by control means, so as to modify the angle of inclination of said at least some of said fins, said rotary drive system comprising at least one electric motor powered by a current source, the electric motor and the current source being disposed in said inner portion, wherein, when the angular position of one of said fins is to be modified, said at least one electric motor operates on it intermittently under the control of at least one capacitor which intermittently discharge power to said at least one electric motor.

13. A device for controlling steering of a towed underwater object, the device comprising:

a body having a longitudinal axis and comprising:

a stationary inner portion that is constrained in rotation relative to the towed underwater object and provided with fastener means for fastening it releasably to said object; and an outer shell that is movable in rotation relative to the stationary inner portion, about said longitudinal axis;

a plurality of stabilizer fins, each of which is coupled to the body and extends along an axis that is transverse to the longitudinal axis of said body, the angular position of at least some of said fins relative to the body being pivotable about its transverse axis by means of a rotary drive motorized system and by control means, so as to modify the angle of inclination of said fins; and an on-board processing electronics, said on-board processing electronics and the rotary drive motorized system being exclusively disposed in said inner portion of the body, so that no electrical power or data passes between the inner portion and the outer shell of said body, wherein said rotary drive motorized system comprises at least one capacitor having power charging time and intermittent power discharging times for intermittently discharging power in at least one motor which operates intermittently on at least one of said fins when the angular position thereof is to be modified.

* * * * *